United States Patent [19]

Longbottom

[11] 3,976,016

[45] Aug. 24, 1976

[54] OVERBED TABLE WITH LOCKING MECHANISM

[75] Inventor: John Douglas Longbottom, Haddonfield, N.J.

[73] Assignee: RCA Corporation, New York, N.Y.

[22] Filed: Dec. 23, 1974

[21] Appl. No.: 535,811

[52] U.S. Cl. ..... 108/144; 108/148; 248/157; 248/412

[51] Int. Cl.[2] ..... A47B 9/08

[58] Field of Search ..... 248/411, 412, 125, 157, 248/161, 414; 108/144, 146, 148, 10; 297/345, 338

[56] References Cited

UNITED STATES PATENTS

| | | | |
|---|---|---|---|
| 373,303 | 11/1887 | Patzer | 248/411 |
| 1,101,552 | 6/1914 | Hume | 248/412 |
| 1,103,839 | 7/1914 | Rellay | 248/412 |
| 1,556,735 | 10/1925 | Tiffany | 108/144 X |
| 3,027,209 | 3/1962 | Nielsen | 108/144 X |
| 3,113,793 | 12/1963 | Harwood | 248/161 X |
| 3,231,306 | 1/1966 | Almasy | 108/144 X |
| 3,286,663 | 11/1966 | Mann et al. | 108/144 |
| 3,534,935 | 10/1970 | Gunn | 108/146 |

FOREIGN PATENTS OR APPLICATIONS

| | | | |
|---|---|---|---|
| 450,054 | 8/1941 | Canada | 108/148 |
| 30,060 | 6/1933 | Netherlands | 108/144 |
| 824,868 | 12/1958 | United Kingdom | 108/146 |

*Primary Examiner*—Roy D. Frazier
*Assistant Examiner*—William E. Lyddane
*Attorney, Agent, or Firm*—Edward J. Norton; Raymond E. Smiley

[57] ABSTRACT

An overbed table such as used in a hospital, which is elevated manually by upward pressure and which has a wedging mechanism normally preventing lowering of the table. A release mechanism is operated to release the table for lowering.

4 Claims, 3 Drawing Figures

OVERBED TABLE WITH LOCKING MECHANISM

BACKGROUND OF THE INVENTION

Hospital rooms and other convalescent care rooms normally are equipped with bedside tables having a cantilevered portion which is movable over the patient's bed, on which may be placed food trays or the like for easy handling by the patient. A typical hospital bed has a mechanism which permits it to be raised and lowered either manually by means of a crand, or electronically, by means of a motor. It is, therefore, desirable that the overbed table also be able to be raised and lowered to permit a relatively constant spacing between the bed and table. This task is normally accomplished by a crank mechanism.

If the bed is raised while the table is in a relatively lowered position, an interference will develop between the patient and the underside of the table, a most undesirable event.

SUMMARY OF THE INVENTION

An adjustable table comprises a base member and a table member slidably coupled thereto for movement toward and away therefrom. A wedging means couples the table member and base member for normally preventing movement of the table member toward the base member, while permitting free movement of the table member away from the base member. A release mechanism releases the wedging means to permit movement of the table member toward the base member.

DETAILED DESCRIPTION

Figure 1:
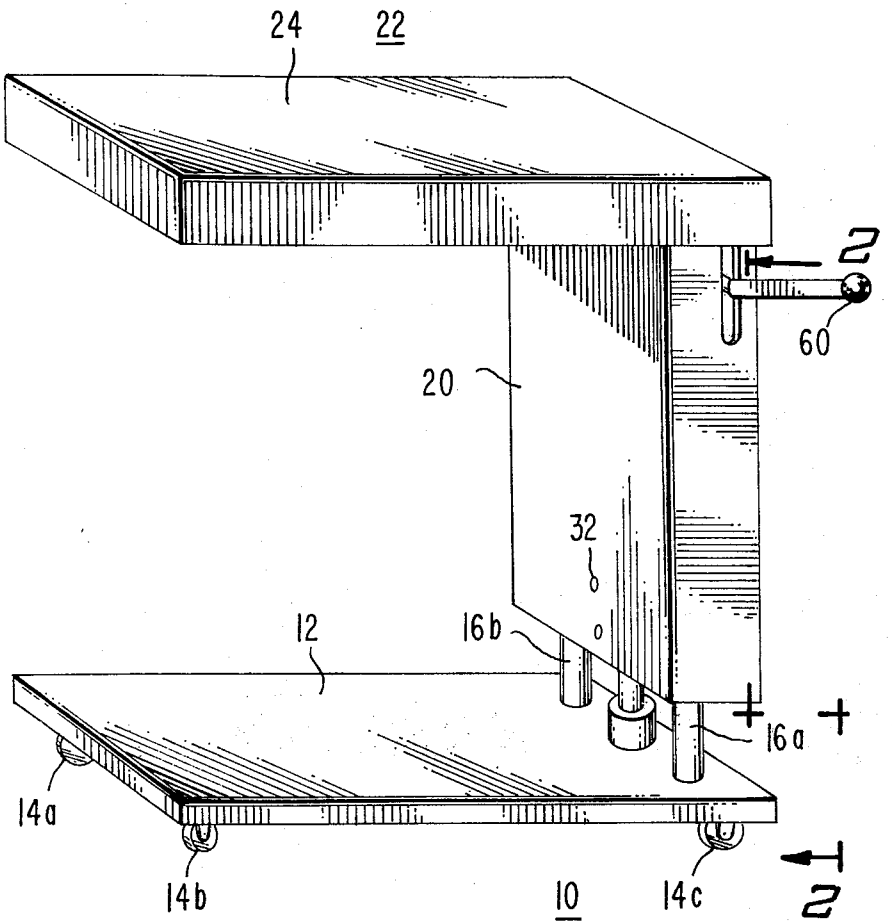
FIG. 1 is an overbed table in perspective.

In FIG. 1, a base member 10 includes a horizontal pan 12 to which are pivotally coupled four casters 14 (only three of which, 14*a*, *b*, *c*, are visible), permitting movement about the floor. Attached to pan 12 are two parallel spaced apart vertical square tubes 16*a* and 16*b*.

In FIG. 1, the major portion of tubes 16*a* and 16*b* are hidden from view by a housing 20, which is part of a table assembly 22. Table assembly 22 also includes a table portion 24 cantilevered from housing 20. As is well known to those skilled in the art, table portion 24 is usually tiltable in one or more directions to facilitate use by the patient. It may also include a mirror, tray, and storage compartment.

The cantilever arrangement of table 24 facilitates positioning over a hospital bed (not shown). Such hospital beds are well known, one being shown and illustrated in U.S. Pat. No. 3,644,945, issued to Robert Goodman, et al., on Feb. 29, 1972. The bed, as shown and described in the patent, may be raised and lowered at the convenience of the patient or room attendent, which makes it necessary that the overbed table also be raised and lowered so as to maintain a desired vertical spacing between the bed (and thus a patient being therein) and table.

Figure 3:
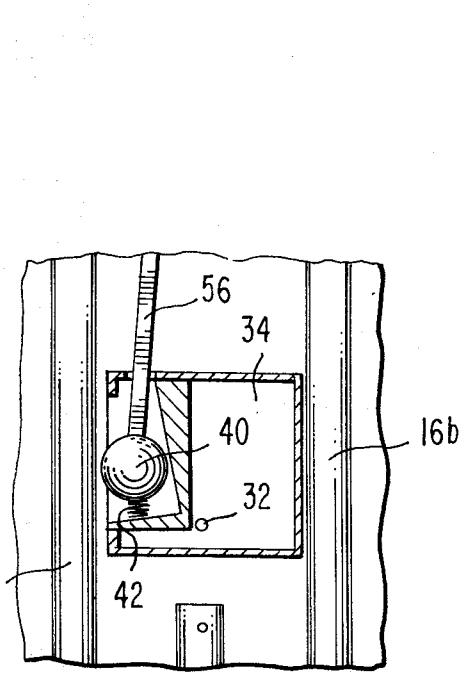
FIG. 3 is a portion of the locking mechanism as illustrated in FIG. 2, showing the locking mechanism in its released condition.
Figure 2:
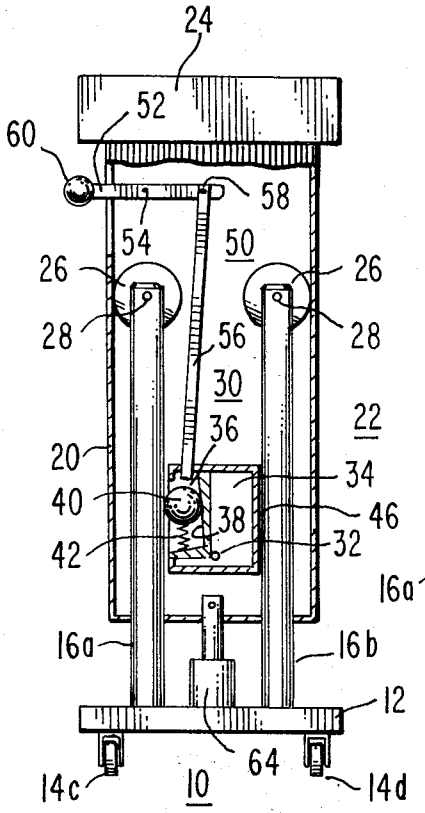
FIG. 2 is a cross section of the table of FIG. 1 generally along lines 2-2, showing in detail the locking mechanism.

The table raising and lowering mechanism is illustrated in FIG. 2, with is a cross-section generally along lines 2—2 of FIG. 1, to which attention is now directed. At the upper portion of each of tubes 16*a*, *b*, is a rotatably attached guide roller 26, attached via a pin 28. These rollers contact the inner surfaces of housing 20 to provide vertical guidance to the same. Further vertical guidance of table 22 is provided by wedging means or locking mechanism 30, which is located between tubes 16*a* and 16*b*, and is pivotally attached to housing 20 by pin 32. Wedging means 30 comprises a cam member 34, having hollowed out portion 36, the cam surface 38 of which inclines slightly toward the one of tubes 16*a*, *b*, nearest the hollowed out portion (that is, toward channel 16*a* as illustrated in FIG. 2).

A roller 40 resides in hollowed out portion 36. A bias means in the form of a compression spring 42 urges roller 40 upward toward the narrower portion of hollowed out portion 36. The result of the arrangement is that roller 40 normally resides against channel 16*a* while opposed surface 46 of cam member 34 resides against channel 16*b* (a slight gap between surface 46 and channel 16*b* is shown for ease of drafting only). With wedge means 30 positioned as shown, any downward pressure on table member 24 causes a wedging action between roller 40, cam member 34 and channels 16*a*, *b* preventing such downward motion. Conversely, any upward force on the table such as by an attendant or on the underside of table portion 24 by the body of the patient as the bed (not shown) is raised will cause roller 40 to be moved relatively downward into the wider hollowed out portion 36 permitting free upward movement of table member 22.

A release mechanism 50 comprises a release bar 52 projecting through an opening in the side of housing 20 pivotally attached to the housing by pin 54 and an elongated shaft 56 pivotally attached at one end to release bar 52 at 58. The free end of shaft 56 is positioned over roller 40. Therefore, when a knob 60, attached to release bar 52, is lifted, the resultant downward pressure on roller 40 causes the release of table member 22, permitting it to be lowered toward base member 10 (see FIG. 2).

A spring and damper mechanism 64 may be coupled between hosuing 20 and base pin 12 to prevent sudden lowering of table member 22 when knob 60 is lifted, and to provide some upward bias to aid in lifting the table when that is desired.

Alternatively or additionally a coiled flat spring may be attached to each of posts 28 and to housing 20 to provide upward bias to the table.

The shape of channels 16*a*, *b* and of roller 40 and cam member 34 are arbitrary, so long as sufficient surface area contact is made to provide the desired friction. For ease of manufacturing tubes 16*a*, *b* would desirably have flat surfaces matching those on cam member 34 and roller 40.

What is claimed is:

1. A table adjustable to different heights comprising in combination:

a base member;

a table member slideably coupled to said base member for movement toward and away therefrom;

one of said base member and table member having two spaced apart parallel guides for guiding the other;

a cam member moveably connected to the other of said table member and said base member and in sliding contact with one of said parallel guides; and a roller member interposed between said cam member and the other of said parallel guides, the interaction of said roller member and said cam member causing an interference between said cam member and said one of said parallel guides simultaneously with an interference between said roller member and the other of said parallel guides when said table member is attempted to be moved toward said base member.

2. The combination as set forth in claim 1, wherein said base member comprises a substantially horizontal member including a plurality of roller means for enabling horizontal movement of said table and wherein said two spaced-apart parallel guides are in vertical relationship to said horizontal member.

3. The combination as set forth in claim 1 further including means for releasing said cam member and roller member to permit movement of said table member toward said base member.

4. A hospital overbed table adjustable to different elevations comprising in combination:

a base portion including a plurality of rollers to permit horizontal movement of the table and including two parallel substantially vertical guide members;

a table member slideably coupled to said base portion for movement up and down relative thereto guided by said parallel guide members;

a camming means moveably coupled to said table member to be moveable therewith and positioned between said two parallel guide members, said camming means including a cam member and roller member arranged so that wedging is effected between the roller member and one said guide member simultaneously with wedging between the cam member and the other said guide member to prevent said table being lowered and arranged to allow free movement of said table as it is being raised; and a release mechanism coupled to said camming means which is operated to release said camming means when it is desired to lower said table member.

* * * * *